US006886718B2

(12) United States Patent
Foster et al.

(10) Patent No.: US 6,886,718 B2
(45) Date of Patent: May 3, 2005

(54) ERGONOMIC TRIGGER FOR A TRIGGER SPRAYER

(75) Inventors: Donald D. Foster, St. Charles, MO (US); Jeffrey P. Stark, Wentzville, MO (US)

(73) Assignee: Continental AFA Dispensing Company, St. Peters, MO (US)

( * ) Notice: Subject to any disclaimer, the term of this patent is extended or adjusted under 35 U.S.C. 154(b) by 0 days.

(21) Appl. No.: 10/417,921

(22) Filed: Apr. 16, 2003

(65) Prior Publication Data

US 2004/0217134 A1 Nov. 4, 2004

(51) Int. Cl.[7] ..... B67D 05/40

(52) U.S. Cl. ..... 222/383.1; 222/372; 239/333; 239/343

(58) Field of Search ..... 222/383.1, 372; 239/333, 343

(56) References Cited

U.S. PATENT DOCUMENTS

| | | | | |
|---|---|---|---|---|
| 3,061,202 A | * | 10/1962 | Tyler | 222/383.1 |
| 3,112,849 A | | 12/1963 | Wallace | |
| 3,650,473 A | * | 3/1972 | Malone | 222/383.1 |
| 3,685,739 A | * | 8/1972 | Vanier | 222/383.1 |
| 3,904,086 A | * | 9/1975 | Losenno | 222/146.5 |
| 4,449,696 A | | 5/1984 | Hengesbach | |
| 4,489,890 A | * | 12/1984 | Martin | 222/383.1 |
| 4,826,052 A | | 5/1989 | Micallef | |
| 5,207,359 A | | 5/1993 | Steijns | |
| D376,318 S | | 12/1996 | Hildebrand | |
| 5,695,095 A | | 12/1997 | Hildebrand | |
| 5,699,968 A | | 12/1997 | Hung | |
| 5,762,236 A | | 6/1998 | Foster et al. | |
| D417,151 S | | 11/1999 | Spengler | |
| 6,390,390 B1 | | 5/2002 | Hung | |
| 6,626,382 B1 | | 9/2003 | Liu | |

FOREIGN PATENT DOCUMENTS

JP 63272675 A * 11/1988 ..... B65D/47/34

* cited by examiner

*Primary Examiner*—Theresa Trieu
(74) *Attorney, Agent, or Firm*—Thompson Coburn, LLP

(57) ABSTRACT

A liquid dispensing, manually operated trigger sprayer has a trigger with an ergonomic finger engagement surface. The trigger finger engagement surface extends longitudinally across the front of the trigger and has a protrusion at the top of the surface. The protrusion has a finger engagement surface portion that rests on the top of a finger of a user's hand while the user's hand manipulates the trigger of the trigger sprayer.

10 Claims, 4 Drawing Sheets

ERGONOMIC TRIGGER FOR A TRIGGER SPRAYER

BACKGROUND OF THE INVENTION (1) Field of the Invention

The present invention pertains to a trigger sprayer apparatus of the type comprising a sprayer housing that is removably attached to a liquid container and has a dispensing nozzle and a manually operated trigger that is manipulated to draw liquid from the container and dispense the liquid from the dispensing nozzle as a spray, stream or foam. In particular, the present invention pertains to an ergonomic trigger for a trigger sprayer. The trigger has a finger engagement surface extending upwardly across the front of the trigger and a protrusion at the top of the trigger that has a finger engagement surface portion that comfortably rests on the top of a finger of the hand of a user of the trigger sprayer.

(2) Description of the Related Art

In prior art trigger sprayers employed in dispensing liquid from liquid containers attached to the trigger sprayers, the typical trigger sprayer is comprised of a sprayer housing having a nozzle for dispensing the liquid from the container, a trigger mounted on the sprayer housing for pivoting movement relative to the sprayer housing, a pump contained in the sprayer housing that is connected to the trigger for operation of the pump in response to pivoting movement of the trigger. Operation of the pump draws liquid from the container into the pump, and then pumps the liquid through the sprayer housing discharging the liquid from the nozzle in a spray, stream or foam pattern.

Triggers of prior art trigger sprayers typically have a longitudinal length and a lateral width where the length of the trigger is substantially larger than the width. The trigger length has opposite front and rear surfaces where the front surface is designed for engagement by the fingers of a hand of a user of the trigger sprayer. The rear surface is operatively connected to the pump of the trigger sprayer. A pair of laterally spaced flanges are usually formed at the top of the trigger. The spacing between the flanges is designed to enable the flanges to be positioned on opposite sides of the sprayer housing adjacent the trigger sprayer nozzle. Pivot posts are provided on the flanges and together with the flanges provide a pivoting connection of the trigger to the sprayer housing. The length of the trigger extends from the pivot connection at the top end of the trigger to an opposite bottom end of the trigger.

A principal consideration in the design of prior art triggers for trigger sprayers is the functioning of the trigger. In the design of prior art trigger sprayers it was contemplated that the manual reciprocation of the trigger on the trigger sprayer would occur for only a short period of time. Only two or three pivoting movements of the trigger by the hand of a user of the trigger sprayer are needed to dispense a desired amount of liquid, for example cleaning liquid, on a household surface such as a glass surface or countertop surface. Because the trigger was manually manipulated only a few number of times each time a desired amount of liquid was dispensed by the trigger sprayer, the comfort to the user's hand manually manipulating the trigger was not a primary concern in the trigger's design.

The use of trigger sprayers has now expanded into other areas of use where the users hand manipulates the trigger on the trigger sprayer a greater number of times to dispense a greater amount of liquid from the trigger sprayer. For example, commercial cleaning services employ trigger sprayers to dispense cleaning liquids. In commercial cleaning services a user of the trigger sprayer will manually manipulate the trigger of the trigger sprayer a significantly greater number of times than is typically the case in use of a trigger sprayer in household cleaning. The increase in the number of manual manipulations of the trigger on a trigger sprayer often results in discomfort to the user's hand due to the orientation of the trigger on the trigger sprayer. Prior art triggers typically project downwardly at an angle from the trigger spray housing and angle away from the connection of the trigger sprayer housing to the liquid container. Repeated manual manipulation of the trigger gradually moves the fingers of the user's hand upwardly across the front surface of the trigger until the topmost finger of the user's hand is rubbing against the underside of the sprayer housing or the underside of the trigger sprayer nozzle. This leads to discomfort of the top finger of the user's hand after repeated manipulations of the trigger sprayer trigger.

SUMMARY OF THE INVENTION

The present invention overcomes the aforesaid disadvantages typically associated with prior art trigger sprayer triggers by providing an improved trigger having an ergonomic engagement surface that reduces the discomfort of the fingers of the user's hand during prolonged use of the trigger sprayer.

As in prior art triggers, the ergonomic trigger of the invention is provided with a pair of laterally spaced flanges with pivot posts at the upper, proximal end of the length of the trigger. The flanges are positioned around laterally opposite sides of the trigger sprayer housing in establishing a pivoting connection of the trigger proximal end to the sprayer housing. The length of the trigger extends downwardly from the pivoting connection at the trigger proximal end to the distal end of the trigger.

The trigger has a longitudinal length between its opposite proximal and distal ends with opposite front and rear surfaces. Laterally spaced side edges of the trigger length separate the trigger front surface from the trigger rear surface. The front surface of the trigger serves as the engagement surface for the fingers of a user's hand. The rear surface of the trigger is operatively connected to the pump of the trigger sprayer.

The improvement of the trigger of the invention is provided by a protrusion that projects outwardly from the trigger front surface. The protrusion is positioned on the trigger front surface adjacent and beneath the sprayer housing of the trigger sprayer. The finger engagement surface on the front of the trigger extends upwardly as a continuous curved surface that extends longitudinally along the front of the trigger and along a portion of the protrusion on the trigger. The portion of the finger engagement surface on the protrusion overhangs or projects outwardly from the trigger engagement surface on the front surface of the trigger. Thus, the portion of the finger engagement surface on the protrusion is positioned to extend over the upper finger of a user's hand holding the sprayer housing to manipulate the trigger relative to the trigger sprayer. The protrusion thereby prevents the upper finger of the user's hand from coming into contact with the trigger sprayer when the user's hand manipulates the trigger. In addition, the smooth continuous surface of the finger engagement surface on the front of the trigger and the portion of the finger engagement surface that extends across the protrusion comfortably supports the weight of the trigger sprayer and the attached liquid container on the top finger of the user's hand.

BRIEF DESCRIPTIONS OF THE DRAWING FIGURES

Further features of the invention are set forth in the following detailed description of the preferred embodiment of the invention and in the drawing figures wherein.

DETAILED DESCRIPTION OF THE PREFERRED EMBODIMENT

The ergonomic trigger of the present invention is described herein as being employed on a manually operated liquid dispensing trigger sprayer of a particular construction. However, it should be understood that the ergonomic trigger of the invention may be employed on various different types of manually operated trigger sprayers and various different types of manually operated apparatus employing a trigger. Although the trigger of the invention is described as being employed with one particular construction of trigger sprayer, it should be understood that this explanation of the trigger of the invention is illustrative only and should not be interpreted as limiting the trigger for use with only one particular construction of trigger sprayer.

Figure 1:
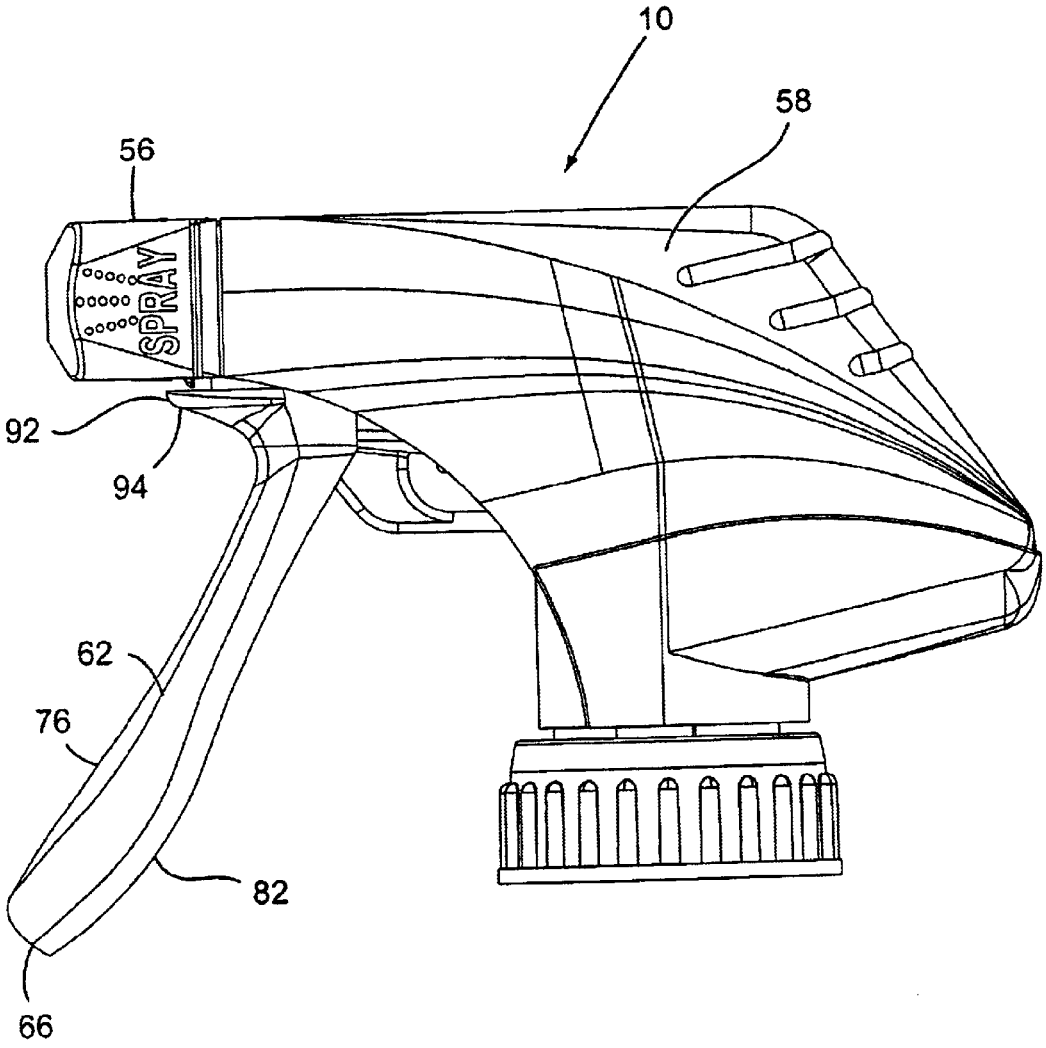
FIG. 1 is a side elevation view of a trigger sprayer employing the trigger of the invention.
Figure 2:
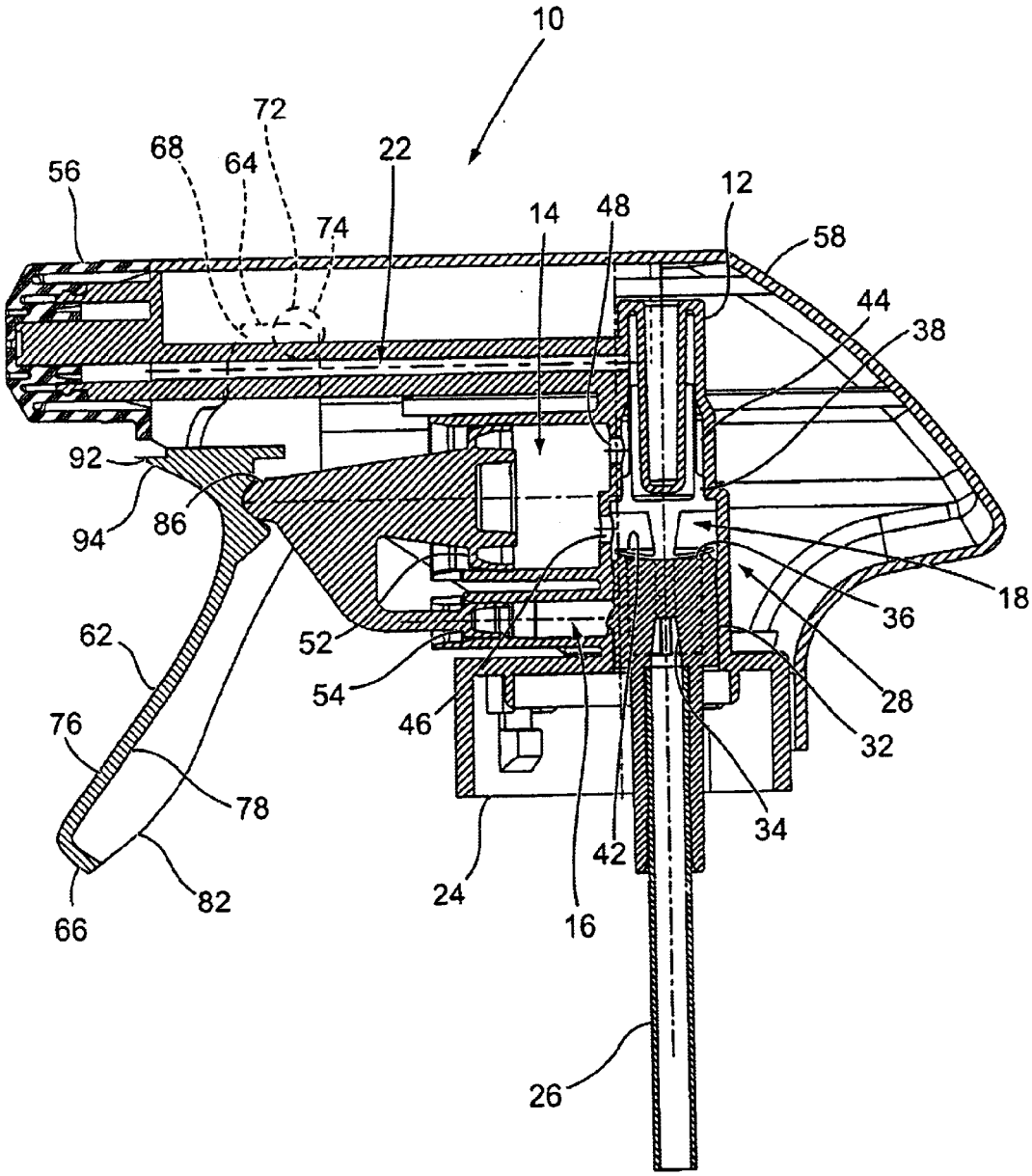
FIG. 2 is a side, sectioned view of the trigger sprayer of FIG. 1.
Figure 3:
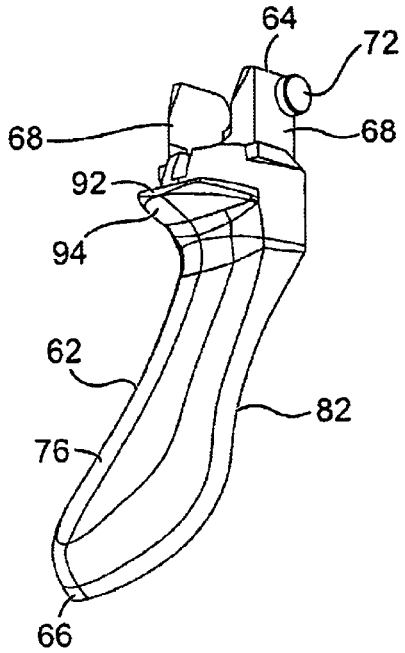
FIG. 3 is a front perspective view of the trigger.
Figure 4:
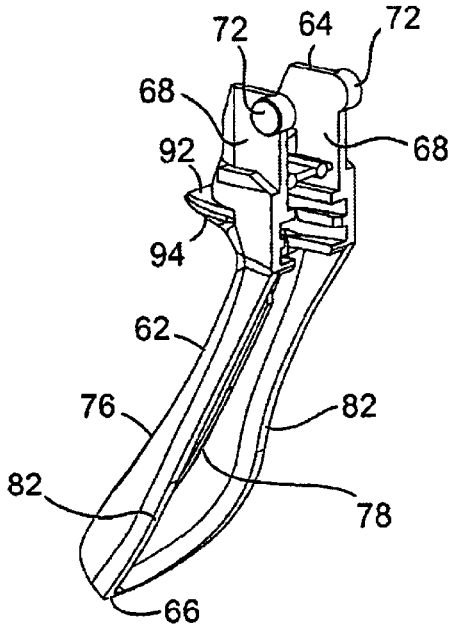
FIG. 4 is a rear perspective view of the trigger.

The trigger sprayer 10 of FIGS. 1 and 2 is similar to other prior art trigger sprayers in that it is basically comprised of a sprayer housing 12 that contains a pump chamber 14, a vent chamber 16, a liquid supply passage 18 and a liquid discharge passage 22. The sprayer housing 12 shown in FIGS. 1 and 2 employs an integral connector cap that removably attaches the sprayer housing 12 to a separate liquid container. The connector cap 24 in FIG. 2 is a bayonet type connector for connecting the sprayer housing to the liquid container (not shown). However, other types of connectors like screw-threaded connectors may also be employed. In addition, the connector cap 24 may be a separate component part of the trigger sprayer and need not be an integral part of the sprayer housing as shown in FIG. 1.

A dip tube 26 is connected to the liquid supply passage 18 of the sprayer housing. As is conventional, the dip tube 26 extends downwardly from the sprayer housing 12 into the liquid in the liquid container (not shown) to which the sprayer housing is attached.

The sprayer housing 12 contains a unique double valve assembly 28. The double valve assembly 28 separates the liquid supply passage 18 from the liquid discharge passage 22. The double valve assembly 28 includes a cylindrical valve seat 32 that has a hollow interior bore 34 extending through its length. The dip tube 26 is connected to the bottom of the valve seat 32. A circular valve seat surface 36 is provided at the top of the valve seat 32. The double valve assembly 28 also includes a valve member 38 having a disk valve 42 at a lower end of the member and a sleeve valve 44 at an upper end of the member. The disk valve 42 resiliently seats against the valve seat surface 36 and controls the flow of liquid through the dip tube 26, the liquid supply passage 18 and a liquid inlet port 46 into the pump chamber 14, and prevents the reverse flow of liquid. The sleeve valve 44 resiliently seats against an interior surface of the liquid discharge passage 22 and controls the flow of liquid from the pump chamber 14 through a pump chamber outlet port 48 and through the liquid discharge passage 22 and prevents the reverse flow of liquid.

A pump piston 52 is mounted in the pump chamber 14 for reciprocating movement of the piston between charge and discharge positions of the piston relative to the pump chamber. When moved to the charge position the pump piston 52 draws liquid into the pump chamber 14 and when moved to the discharge position the pump piston 52 pumps the liquid from the pump chamber 14.

A vent piston 54 is connected to the pump piston 52. The vent piston 54 is mounted in the vent chamber 16 for reciprocating movement between vent open and vent closed positions relative to the vent chamber. In the vent open position the interior of the liquid container (not shown) is vented through the vent chamber 16 to the exterior environment of the sprayer housing 12. When the pump piston 52 is moved inwardly in the pump chamber 14 toward its discharge position, the vent piston 54 is also moved inwardly in the vent chamber 16 toward its open vent position. When the pump piston 52 is moved outwardly from the pump chamber 14 toward its charge position, the vent piston 52 also moves outwardly relative to the vent chamber 16 to its vent closed position. A coil spring (not shown) is typically positioned in the pump chamber 14 and engages against the pump piston 52 biasing the pump piston toward its charge position relative to the pump chamber 14. Thus, the spring also biases the vent piston 54 toward its vent closed position relative to the vent chamber 16.

An indexing nozzle 56 is mounted on the sprayer housing 12 where the liquid discharge passage 22 exits the sprayer housing. The nozzle 56 can be turned on the sprayer housing 12 to selectively stop and permit liquid discharge from the sprayer housing 12. In addition, the indexing nozzle 56 can be rotated to other positions of the nozzle relative to the sprayer housing 12 where the spray pattern of the liquid discharged from the sprayer housing is changed between a spray, stream and foam discharge pattern.

An ornamental shroud 58 is attached to and covers over the sprayer housing 12. The shroud 58 gives the trigger sprayer an aesthetically pleasing exterior appearance.

The trigger 62 of the invention has a longitudinal length between a top, proximal end 64 of the trigger and an opposite bottom, distal end 66 of the trigger. The top, proximal end 64 of the trigger is provided with a pair a laterally spaced flanges 68. The flanges 68 extend upwardly around the opposite lateral sides of the sprayer housing 12. Each of the flanges 68 has a pivot post 72. The posts 72 are coaxial and project outwardly from the opposite lateral sides of the flanges 68. Each of the posts 72 engages in a socket 74 in extending portions of the sprayer housing 12 providing a pivot connection between the trigger 62 and the sprayer housing. The pivot connection provided by the flanges 68 and the posts 72 is one example of a conventional pivot connection of the trigger 62 to the sprayer housing 12. Other types of conventional pivoting connections between the trigger and the sprayer housing may also be employed.

The longitudinal length of the trigger 62 extends downwardly from the pivot connection provided by the flanges 68 and posts 72 below the sprayer housing 12 to the trigger distal end 66. As seen in FIG. 1, a majority of the length of the trigger 62 is positioned below the sprayer housing 12 and outside of the trigger sprayer shroud 58. The trigger 62 has opposite front 76 and rear 78 surfaces. Laterally spaced side edges 82 of the trigger extend downwardly along the longitudinal length of the trigger from the flanges 68 at the trigger top end 64 to the bottom end 66 of the trigger. The laterally spaced side edges 82 extend between and separate the trigger front surface 76 from the trigger rear surface 78.

The trigger rear surface 78 is operatively connected to the pump piston 52 and vent piston 54. The connection between the trigger rear surface 78 and the pump piston 52 and vent piston 74 is provided by a laterally extending pivot post 86 on the pump piston 52 and vent piston 54 that engages in a pair of opposed sockets in opposite sides of the trigger rear surface 78. This pivoting connection of the pump piston 52 and vent piston 54 to the trigger rear surface 78 is conventional and has not been shown in detail in the drawing figures. Other types of conventional connections between the trigger 62 and pump piston 52 and vent piston 54 may also be employed.

The front surface 76 of the trigger 62 functions as the engagement surface for the fingers of a user's hand holding and operating the trigger sprayer. One or more of the fingers of the user's hand may engage against the trigger front surface 76 when manipulating the trigger 62 relative to the sprayer housing 12 to pump liquid to the pump chamber 14 and dispense the liquid from the pump chamber through the discharge nozzle 56. The improvement to the trigger 62 of the invention is provided in the ergonomic configuration of the trigger front surface 76 and in particular by a protrusion 92 that extends outwardly from the trigger front surface 76.

Figure 6:
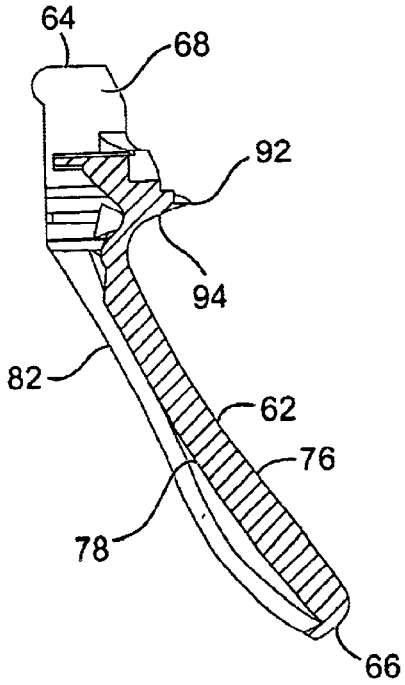
FIG. 6 is a cross-section view of the trigger along the line 6—6 of FIG. 5.
Figure 5:
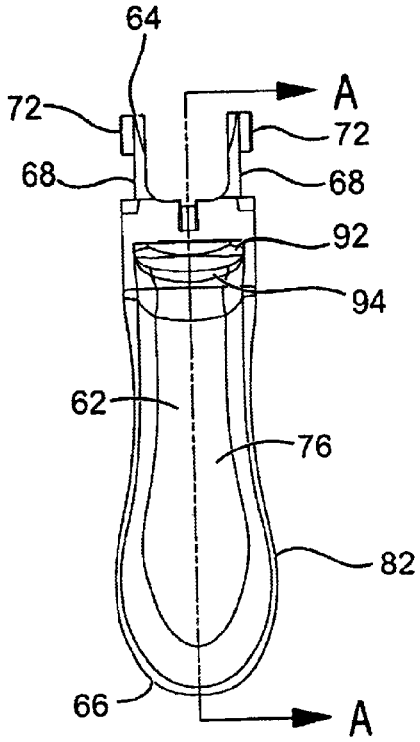
FIG. 5 is a front view of the trigger.
Figure 8:
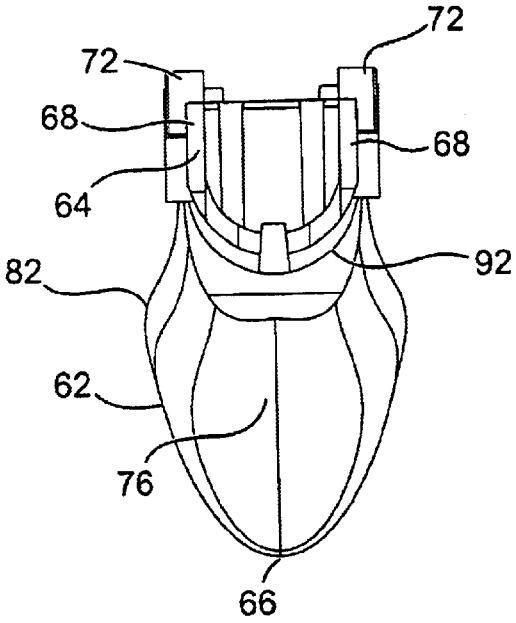
FIG. 8 is a top view of the trigger.
Figure 7:
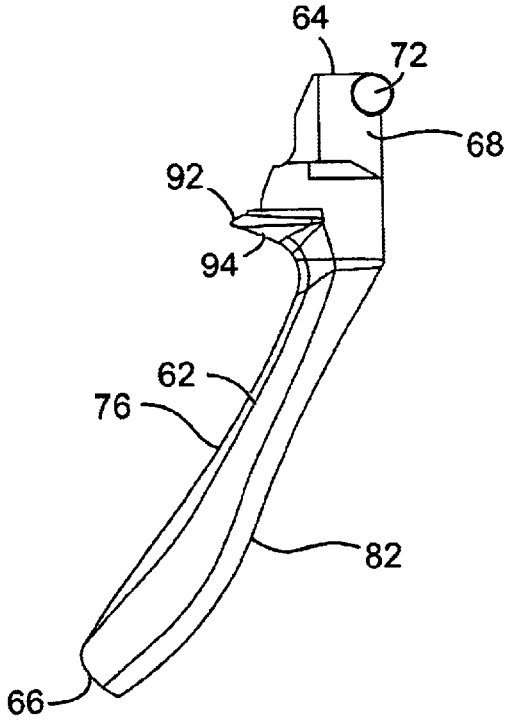
FIG. 7 is a right side view of the trigger with the left side view of the trigger being a mirror image thereof.
Figure 9:
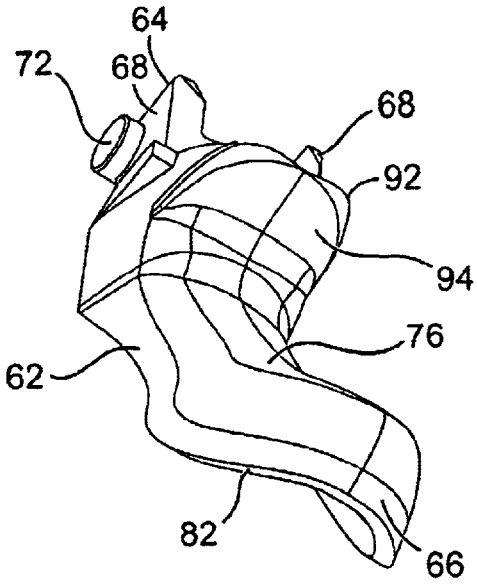
FIG. 9 is a bottom perspective view of the trigger.

As best seen in FIGS. 1 and 6, the protrusion 92 projects outwardly from the trigger front surface 76 between the pivot connection at the trigger top end 64 and the trigger bottom end 66. In the preferred embodiment of the trigger 62 of the invention, the length of the trigger and the protrusion 92 are all one monolithic piece. The protrusion 92 is positioned adjacent and below the sprayer housing 12, the nozzle 56 and the sprayer shroud 58. The protrusion 92 has a curved finger engagement surface portion 94 that overhangs the finger engagement surface of the trigger front surface 76. The protrusion finger engagement surface portion 94 is part of a continuous curved surface that extends upwardly across the trigger front surface 76 and across the underside of the protrusion 92. The curved surface orients the engagement surface 94 of the protrusion 92 at an acute angle relative to the trigger front surface 76. In lateral cross-section both the protrusion finger engagement surface 94 and the trigger front surface 76 have convex configurations.

The protrusion 92 is positioned on the trigger 62 so that the finger engagement surface portion 94 on the protrusion extends over the upper finger of a user's hand that is holding the trigger sprayer to manipulate the trigger 62 relative to the sprayer housing 12. The protrusion 92 prevents the upper finger of the user's hand from coming into contact with the underside of the trigger sprayer when the user's hand manipulates the trigger 62. In addition, the smooth continuous surface connecting the trigger front surface 76 with the finger engagement surface portion 94 of the protrusion 92 comfortably receives the fingers of the user's hand. The finger engagement surface portion 94 also comfortably supports a portion of the weight of the trigger sprayer and the attached liquid container on the top finger of the user's hand holding the trigger sprayer.

While the present invention has been described by reference to a specific embodiment, it should be understood that modifications and variations of the invention may be constructed without departing from the scope of the invention defined in the following claims.

What is claimed is:

1. A manually operated, liquid dispensing trigger sprayer comprising:

a sprayer housing;

a liquid pump in the sprayer housing;

a liquid discharge passage in the sprayer housing and communicating with the pump for directing liquid through the sprayer housing and discharging the liquid from the sprayer housing on operation of the pump;

a trigger having a longitudinal length with opposite proximal and distal ends and opposite front and rear surfaces, the trigger proximal end being mounted to the sprayer housing for movement of the trigger relative to the sprayer housing, the trigger front surface having a finger engagement surface positioned to be engaged by fingers of a user's hand holding the trigger sprayer, the trigger rear surface being operatively connected to the pump for operation of the pump in response to movement of the trigger;

a protrusion projecting outwardly from the trigger front surface adjacent the sprayer housing;

the trigger finger engagement surface having a portion on the protrusion;

the trigger and the protrusion are one monolithic piece;

the finger engagement surface on the trigger front surface and an adjacent portion of the finger engagement surface on the protrusion are oriented at an acute angle;

the finger engagement surface on the trigger and the portion of the finger engagement surface on the protrusion having convex configurations laterally across the trigger;

the trigger proximal end having a pivot connection to the sprayer housing; and, the protrusion being spaced from the pivot connection and the trigger distal end.

2. The trigger sprayer of claim 1, further comprising:

the finger engagement surface on the trigger front surface and the portion of the finger engagement surface on the protrusion together define a continuous curved surface along the longitudinal length of the trigger.

3. The trigger sprayer of claim 1, further comprising:

the finger engagement surface on the trigger front surface and the portion of the finger engagement surface on the protrusion are positioned adjacent each other and both are engagable by a single finger of a users hand extending laterally across the trigger.

4. The trigger sprayer of claim 1, further comprising:

the protrusion being spaced from the trigger proximal end and being spaced from the trigger distal end.

5. A manually operated, liquid dispensing trigger sprayer comprising:

sprayer housing;

a liquid rump in the sprayer housing;

a liquid discharge passage in the sprayer housing and communicating with the pump for directing liquid through the sprayer housing and discharging the liquid from the sprayer housing on operation of the pump;

a trigger having a longitudinal length with opposite top and bottom ends and opposite front and rear surfaces, the trigger top end being mounted to the sprayer housing for movement of the trigger relative to the sprayer housing, the trigger rear surface being operatively connected to the pump for operation of the pump in response to movement of the trigger;

a protrusion projecting outwardly from the trigger and overhanging the trigger front surface;

the trigger front surface having a finger engagement surface positioned to engage a finger of a user's hand when the user holds the trigger sprayer;

the protrusion having a finger engagement surface positioned to engage the finger of the user's hand when the user holds the trigger sprayer;

the trigger front surface finger engagement surface and the adjacent protrusion finger engagement surface being oriented at an acute angle; and, the protrusion finger engagement surface having a length that extends the protrusion finger engagement surface over the finger of the user's hand when the user holds the trigger sprayer.

6. The trigger sprayer of claim 5, further comprising:

the trigger and the protrusion being one monolithic piece.

7. The trigger sprayer of claim 5, further comprising:

the protrusion being positioned below the sprayer housing.

8. The trigger sprayer of claim 5, further comprising:

the trigger front surface finger engagement surface and the protrusion finger engagement surface both being part of a continuous curved surface that extends across the longitudinal length of the trigger and across the protrusion.

9. The trigger sprayer of claim 5, further comprising:

the protrusion being spaced from the trigger top end.

10. A manually operated, liquid dispensing trigger sprayer comprising:

a sprayer housing;

a liquid pump in the sprayer housing;

a liquid discharge passage in the sprayer housing and communicating with the pump for directing liquid through the sprayer housing and discharging the liquid from the sprayer housing on operation of the pump;

a trigger having a longitudinal length with opposite to and bottom ends and opposite front and rear surfaces, the trigger top end being mounted to the sprayer housing for movement of the trigger relative to the sprayer housing, the trigger rear surface being operatively connected to the pump for operation of the pump in response to movement of the trigger;

a protrusion projecting outwardly from the trigger and overhanging the trigger front surface;

the trigger front surface having a finger engagement surface positioned to engage a finger of a user's hand when the user holds the trigger sprayer;

the protrusion having a finger engagement surface positioned to engage the finger of the user's hand when the user holds the trigger sprayer;

the trigger front surface finger engagement surface and the adjacent protrusion finger engagement surface being oriented at an acute angle;

a pivot connection on the trigger top end mounting the trigger to the sprayer housing for pivoting movement of the trigger relative to the sprayer housing; and, the protrusion being spaced below the pivot connection.

* * * * *